United States Patent [19]

Burger

[11] Patent Number: 4,948,115

[45] Date of Patent: Aug. 14, 1990

[54] APPARATUS FOR DISPENSING A PRESELECTED MIX OF PAPER CURRENCY OR THE LIKE

[75] Inventor: Fredric W. Burger, Cherry Hill, N.J.

[73] Assignee: Brandt, Inc., Bensalem, Pa.

[21] Appl. No.: 238,032

[22] Filed: Aug. 29, 1988

[51] Int. Cl.[5] ..... B65H 5/02
[52] U.S. Cl. ..... 271/273
[58] Field of Search ..... 271/273, 274

[56] References Cited

U.S. PATENT DOCUMENTS 3,411,771 11/1968 Bahr ..... 271/273
3,618,934 11/1971 Germuska ..... 271/274

*Primary Examiner*—Richard A. Schacher
*Attorney, Agent, or Firm*—Shenier & O'Connor

[57] ABSTRACT

Apparatus for feeding sheets from a plurality of supplies to an output location in which a toggle linkage normally releasably positions the conveyor in an operative position from which it may be moved around an axis adjacent to one of its longitudinal edges to permit access to the feed path.

16 Claims, 4 Drawing Sheets

APPARATUS FOR DISPENSING A PRESELECTED MIX OF PAPER CURRENCY OR THE LIKE

FIELD OF THE INVENTION

The invention is in the field of currency dispensers and relates to an improved currency dispenser which is simpler and more reliable than the currency dispensers of the prior art.

BACKGROUND OF THE INVENTION

There are known in the prior art various forms of apparatus for dispensing a preselected mix of various denominations of paper currency or the like. One such apparatus is shown in Winkler et al U.S. Pat. No. 4,660,822 issued Apr. 28, 1987.

The common belt system of the apparatus shown in the '822 patent includes a belt tray over which the upper lengths of the feed belt extend so as to receive the sheets of currency delivered thereto by the various dispensing units. Means is provided for affording access to the area between the outlets of the feed devices and the belt systems in the event of a jam or the like. More specifically, the belt supporting tray is supported for pivotal movement around the axis of the belt drive shaft. The belt assembly is biased to an operative position at which a takeoff gear on the shaft remote from the drive shaft engages a gear of the system which drives the stacker wheel. When access is desired, an externally operable handle is moved to disable the biasing means to permit the belt assembly, including the tray, to swing to a position at which access can be had through a trapazoidal opening in the side plate of the machine. In the course of this operation the takeoff gear moves out of engagement with the input to the stacker wheel drive. When the handle is released, the springs restore the belt assembly to its operative position and the takeoff gear moves into engagement with the stacker wheel drive system. As an alternative it is suggested that the belt assembly be supported on a parallel motion linkage for movement between operative and inoperative positions. In each of these arrangements movement of the belt and supporting tray to inoperative positions results in disengagement of the stacker wheel drive or disengagement of both the stacker wheel drive and the belt drive. While these systems theoretically accomplish their intended purpose, they are relatively complicated and not as reliable as is desired.

SUMMARY OF THE INVENTION

One object of my invention is to provide apparatus for dispensing a preselected mix of paper currency or the like which is an improvement over the prior art.

Another object of my invention is to provide an improved paper currency dispensing apparatus which is simpler than similar apparatus of the prior art.

A further object of my invention is to provide an improved paper currency dispensing apparatus which is more reliable than is similar apparatus of the prior art.

Yet another object of my invention is to provide an improved paper currency dispensing apparatus with improved means for affording access to clear jams and the like.

Yet another object of my invention is to provide an improved paper currency dispensing apparatus which affords access for clearance of jams without disengagement of any of the drive trains of the apparatus.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals indicate like parts in the various views:

FIG. 1 is a right side elevation of my improved apparatus for dispensing a preselected mix of paper currency or the like.

DESCRIPTION OF THE PREFERRED EMBODIMENT

Figure 1:
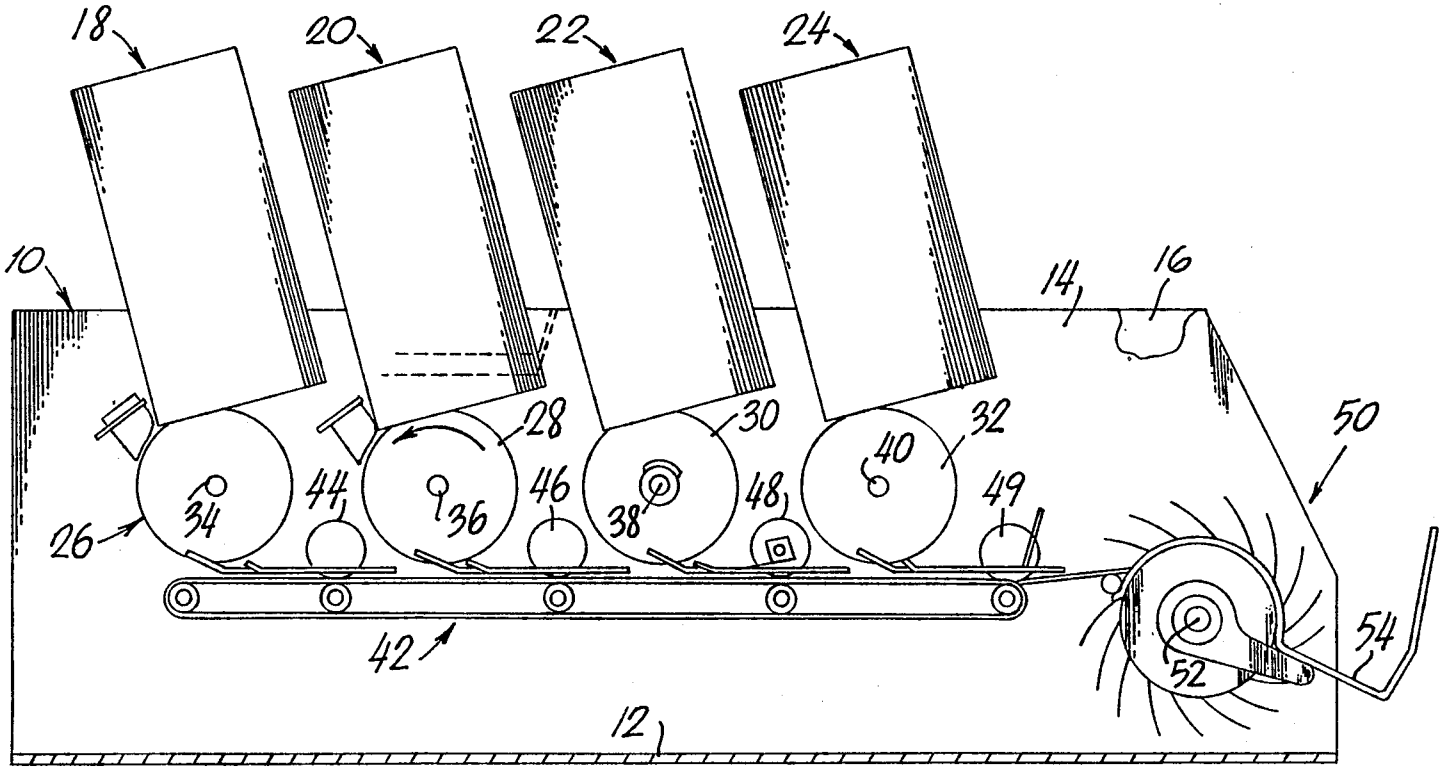

Referring now to FIG. 1, my improved apparatus indicated generally by the reference character 10 has a frame comprising a base 12 and sides 14 and 16. A plurality of cassettes, 18, 20, 22 and 24 holding supplies of paper currency which may, for example, be of different denominations, are supported on the machine frame in the manner described in the '822 patent referred to hereinabove. Respective pairs of feed rolls 26, 28, 30, and 32, carried by shafts 34, 36, 38 and 40 are adapted to feed sheets of currency from the supplies in the cassettes to a common belt system indicated generally by the reference character 42 in a manner to be described hereinbelow. Sheets fed to the belt system 42 are carried along by the belt system under pinch rolls 44, 46, 48 and 49 to a stacker wheel 50 carried by a shaft 52 which delivers the sheets to an output tray 54.

Figure 2:
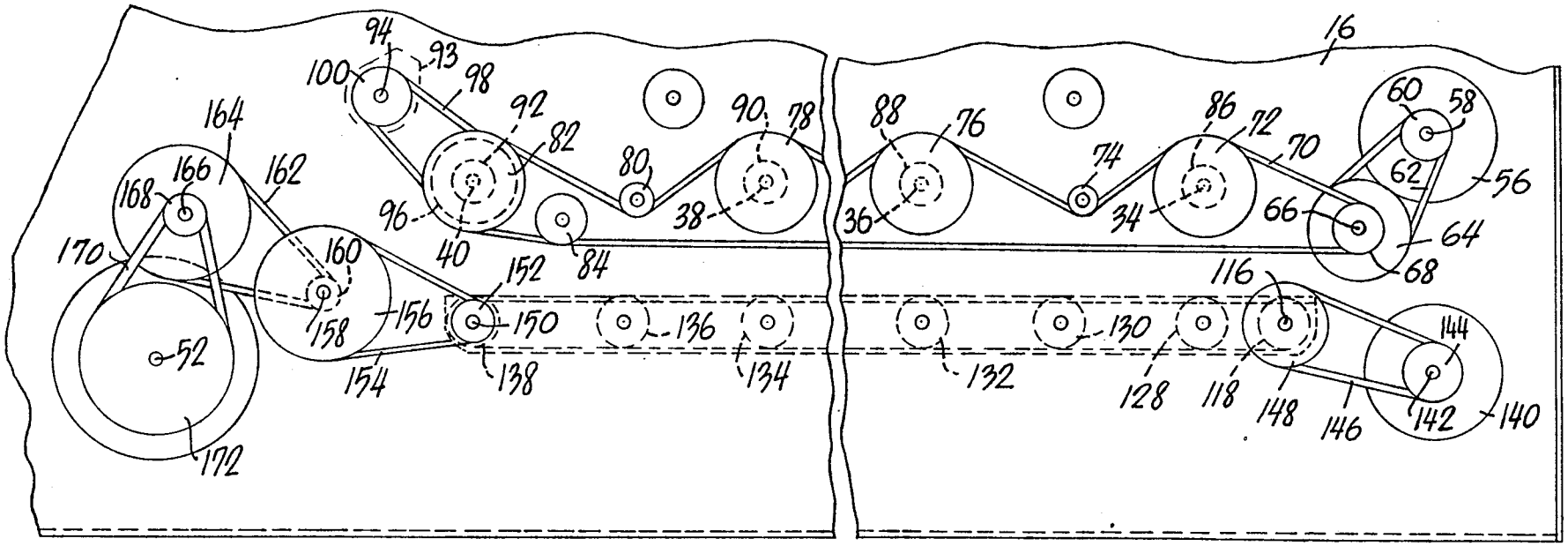
FIG. 2 is a left side elevation of the apparatus of FIG. 1 illustrating the drive systems thereof.
Figure 3:
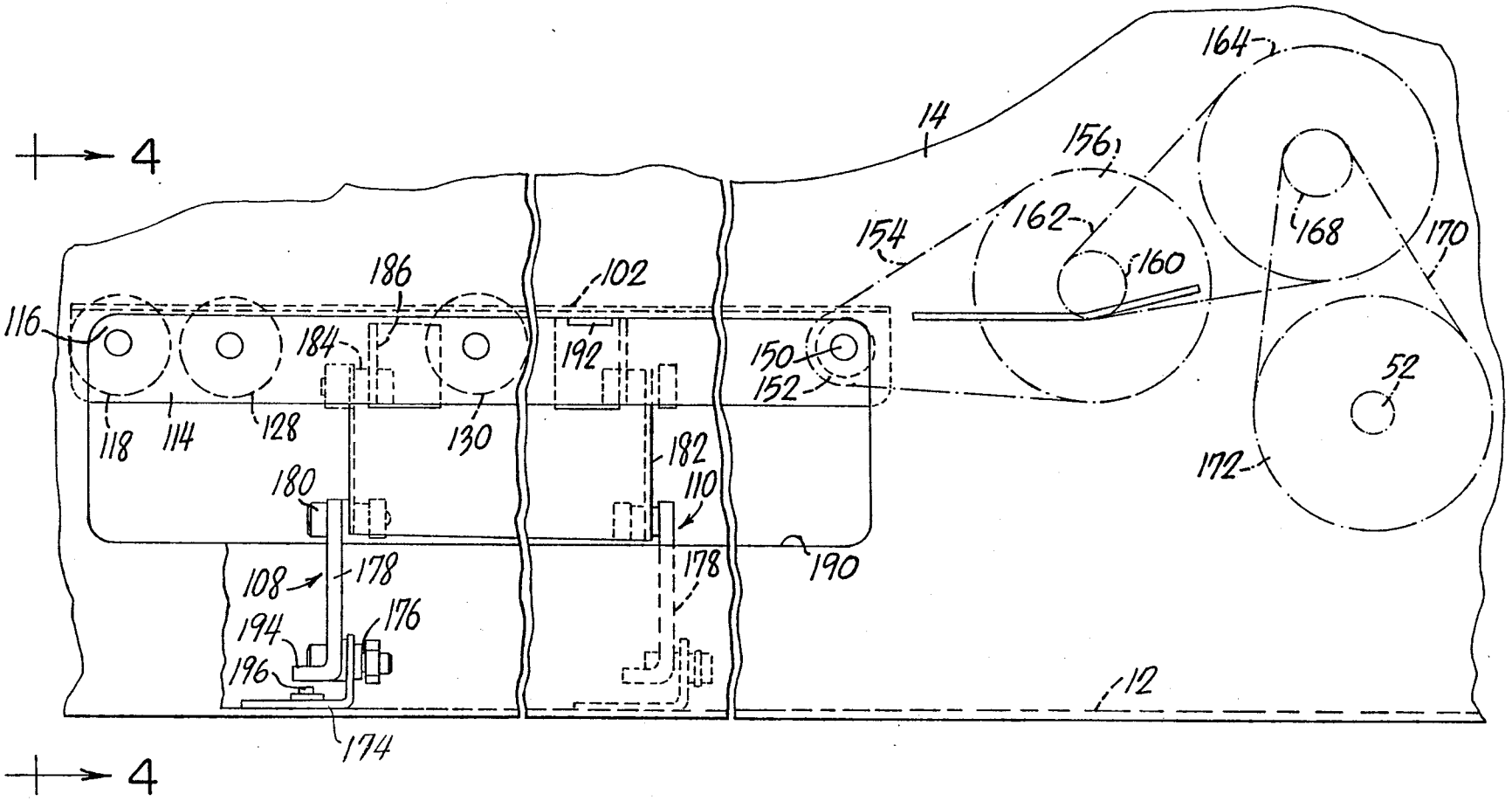
FIG. 3 is a fragmentary right side elevation illustrating the belt tray support mechanism.
Figure 4:
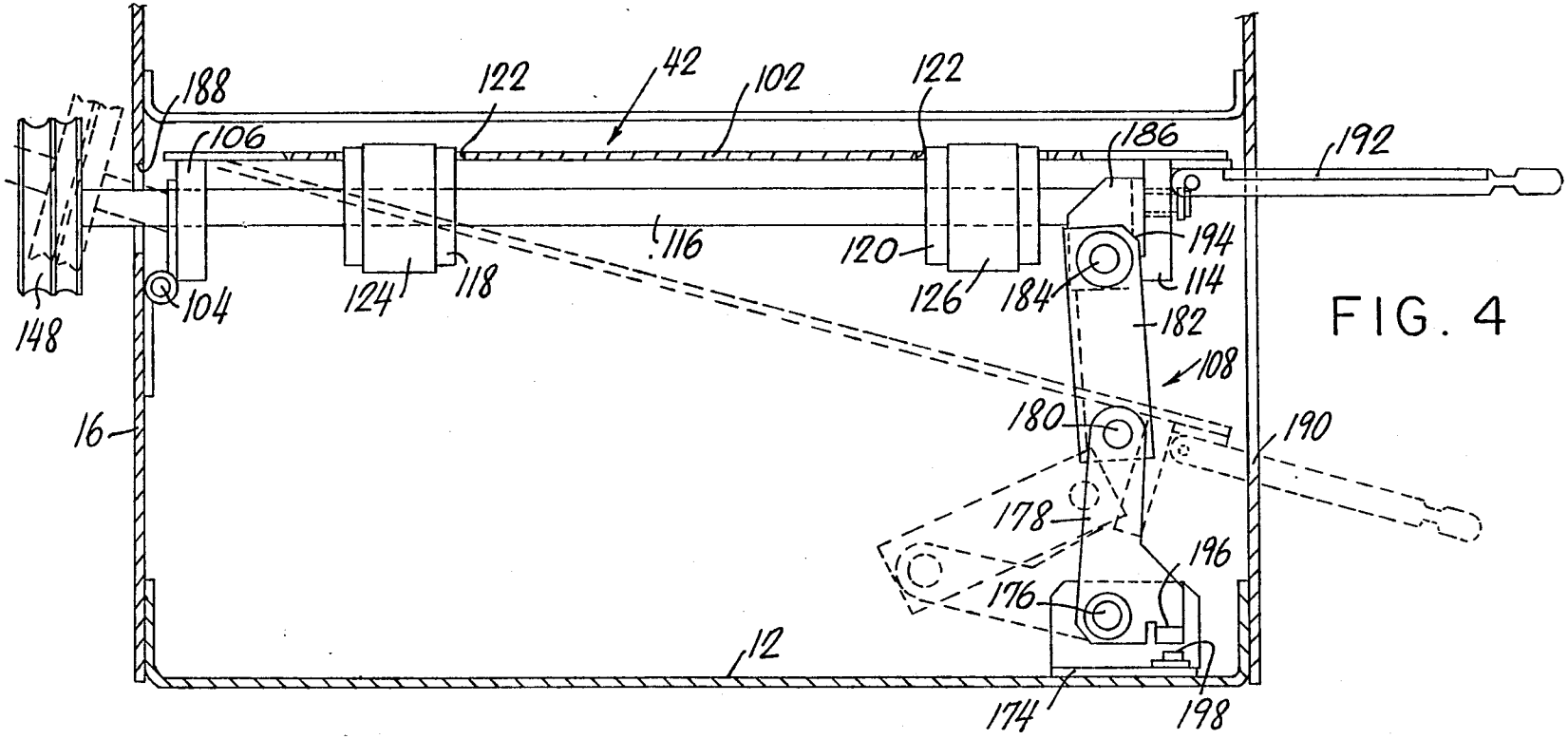
FIG. 4 is an end elevation taken along the line 4—4 of FIG. 3.
Figure 5:
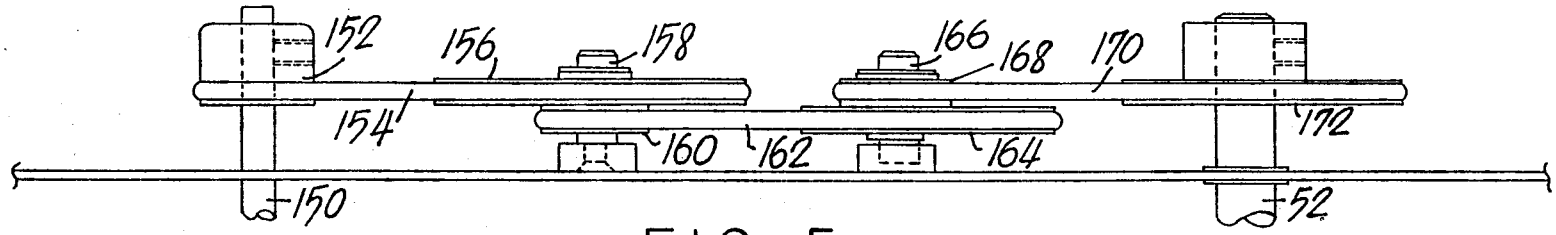
FIG. 5 is a fragmentary view illustrating the stacker wheel drive takeoff of my apparatus.

Referring now to FIG. 2, a first drive motor 56 has a shaft 58 carrying a pulley 60 which drives the belt 62 to drive a pulley 64 carried by a shaft 66. A second pulley 68 on shaft 66 drives the dispensing unit belt 70 which in serpentine fashion passes over a drive pulley 72 under an idler pulley 74 over a drive pulley 76 under another idler puller (not shown) over a drive pulley 78 under an idler pulley 80 and over a drive pulley 82. After passing around the pulley 82, belt 70 passes around an idler pulley 84 which may be a belt tensioning pulley and back to the pulley 68.

Pulleys 72, 74, 78 and 82 provide the drive for the respective feed wheels 26, 28, 30 and 32 associated with cassettes 18, 20, 22 and 24. More specifically, pulley 72 is carried by the input or driving member of a clutch and brake mechanism 86, the output or driven member of which is coupled to the shaft 34. When a sheet of currency is to be fed from the supply in cassette 18 to the belt system 42, the unit 86 is activated to couple shaft 34 to pulley 72. When the feeding operation is complete, the unit 86 is deactivated. Respective clutch and brake units 88, 90 and 92, like the unit 86 are associated respectively with pulleys 76, 78 and 82 and shafts 36, 38 and 40.

Associated with each of the cassettes 18, 20, 22 and 24 is a picker roll 93 adapted to slightly lift the stack of currency. This momentary reduction of load from the respective feed wheels allows the gripping portion of the wheel to withdraw the lowermost sheet from the stack in the associated cassette. The picker roller shaft 94 carries a pulley 100 adapted to be driven by a belt 98 carried by a pulley 96 on the shaft 40 associated with the unit 24, for example. A similar picker roll arrangement is associated with each of the other cassettes 18, 20 and 22.

Referring now to FIGS. 2 to 5, the belt assembly 42 includes a belt tray 102 carrying shaft supports 106 and 114 on the underside thereof along one of its longitudinal edges which is secured to a hinge 104 carried by side 16 so that the entire assembly 42 can swing around the pivot of hinge 104 in a manner to be described. A pair of toggle mechanisms 108 and 110 carried by base 12 normally support the tray 10 a genal horizontal position, as will be described more fully hereinbelow.

A pair of shaft supporting elements 106 and 114 extending along the underside of the tray 102 adjacent to the longtiduinal edges thereof support the roller shafts of the belt mechanism. One of these shafts is a drive shaft 116 carrying a pair of spaced drive rolls 118 and 120 extending slightly above the tray 102 through openings 122. Rolls 118 and 120 carry respective belts 124 and 126 which extend over a plurality of sets of idler rolls 128, 130, 132, 134 and 136 through rolls 138 at the discharge end of the belt assembly 42.

A belt drive motor 140 has a shaft 142 carrying pulley 144 which receives a belt 146 extending around a pulley 148 carried by the drive shaft 116. It will readily be apparent that when motor 140 is energized, the belt system is driven.

The shaft 150 which supports the rolls 138 is a takeoff shaft carrying a pulley 152 which drives a belt 154 extending around a pulley 156 carried by a shaft 158. A small diameter pulley 160 on shaft 158 drives a belt 162 which extends around a relatively large diameter pulley 164 carried by a shaft 166. A smaller diameter pulley 168 on shaft 166 drives a belt 170 extending around a pulley 172 carried by the stacker wheel shaft 52. From the structure just described, it will be appreciated that when the belt system 42 is driven, the stacker wheel shaft 52 is driven at a speed which is less than the speed of shaft 150 by an amount determined by the ratios of the diameters of the sets of pulleys in the drive train between the two.

As has been pointed hereinabove, the belt assembly normally is maintained in a generally horizontal position by the toggle linkages 108 and 110. Since two linkages are substantially identical, only one of the two will be described in detail. The linkage 108, for example, includes a bracket 174 secured to the base 12. Bracket 174 carries a pivot pin 176 which supports an arm 178. The end of arm 178 remote from the pin 176 carries a pivot pin 180 which connects the arm to one end of a cross link 182, the other end of which is secured to a pivot 184 carried by brackets 186 secured to the shaft support 114.

Shaft 116 extends outwardly through an opening 188 in wall 16 to a position at which it receives the drive pulley 148. An operating handle 192 secured to the support 114 at a location generally intermediate the length thereof, extends laterally outwardly through a generally rectangular access opening 190 in the side 14.

In the operative position of assembly 42, handle 92 abuts the upper edge of the opening 190. When the handle 192 is moved downwardly as viewed in FIG. 4 to swing the tray 102 to the broken line position shown, the engagement of member 114 with the edges of link 182 swings the link in a clockwise direction as viewed in FIG. 4 around the pivot 184. In the course of this movement, pivot 180 moves beyond the dead center position so that the tray 102 can move to its fully open position illustrated in broken lines in FIG. 4. In this relative position of the parts, the space below the respective sheet delivery devices is accessible. When the assembly 42 is to be restored to its operative position, handle 192 is pulled upwardly to move the parts to the full line position illustrated in FIG. 4. It is to be noted that the assembly 42 is raised slightly above its operating position before stopping as described below.

In the open position of the parts, it may be that the handle 192 rests on the lower edge of the opening 190. Preferably I provide the edge of each of the arms 178 adjacent to the member 114 with a surface which engages the inner surface of member 114 in the open position of the parts. I also form the arm 178 with a foot 196 adapted to engage an adjustable stop 198 on bracket 174 to limit clockwise movement of the arm 178 and align assembly 42 in a horizontal position, as viewed in FIG. 4.

It will be seen that I have accomplished the objects of the my invention.

I have provided for dispensing a preselected mix of papar currency or the like which is an improvement over the prior art. My apparatus is simpler and more reliable than is similar apparatus of the prior art. I have provided our paper currency dispenser with improved means for affording access to the feed path. My access providing means operates without the necessity of disengaging any of the drive trains of the apparatus.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for feeding sheets along a predetermined path including in combination.

a housing, an elongated assembly in said housing for feeding sheets along said path in the direction of the length of said assembly from one end to the other end thereof, an opening in said housing adjacent to one of the longitudinal edges of said assembly, said assembly comprising upper idler means, means mounting said upper idler means in a fixed position in said housing, lower conveyor means, means for driving said lower conveyor means, means mounting said lower conveyor means for pivotal movement around an axis extending in the direction of the length of said assembly between an operative position at which it cooperates with said idler means to feed documents along said path and an inoperative position remote from said idler means at which said path is accessible through said opening and releasable means for normally retaining said lower conveyor means in said operative position.

2. Apparatus as in claim 1 in which said conveyor means comprises a drive shaft driven by said driving means, said driving means permitting movement of said assembly between said operative and inoperative positions without disengagement therefrom.

3. Apparatus as in claim 2 in which said driving means comprises a pulley carried by said shaft and a belt for driving said pulley.

4. Apparatus as in claim 3 in which said pulley is on the end of said shaft adjacent to said other edge of said assembly.

5. Apparatus as in claim 1 in which said releasable means comprises a toggle linkage.

6. Apparatus as in claim 5 in which said toggle linkage is actuatable between as extended position corresponding to the operative position of said assembly and a retracted position, said extended position corresponding to a beyond dead center position of said linkage, said linkage including means for releasably holding the linkage in beyond dead center position.

7. Apparatus as in claim 6 in which said means for holding said linkage in beyond dead center position comprises a foot and an adjustable stop.

8. Apparatus as in claim 7 including means for inhibiting the movement of said linkage past said retracted position.

9. Apparatus as in claim 8 including means for inhibiting movement of said linkage past said beyond dead center position.

10. Apparatus as in claim 5 including a handle extending outwardly through said opening for actuating said toggle linkage.

11. Apparatus for feeding sheets along a predetermined path including in combination.

an elongated assembly for feeding sheets along said path in the direction of the length of said conveyor means from one end to the other end thereof, said assembly comprising idler means, means mounting said idler means in a fixed position in said housing, conveyor means having a drive shaft extending in a direction generally perpendicular to the length of the conveyor, means coupled to one end of said drive shaft for driving the same, means mounting said conveyor means for pivotal movement around an axis extending in the direction of the length of said assembly and located adjacent to said one end of said shaft from an operative position at which it cooperates with said idler means to feed documents along said path to an inoperative position remote from said idler means without decoupling said drive means, and releasable means for normally retaining said conveyor means in said operative position.

12. Apparatus as in claim 11 in which said drive means comprises a pulley carried by said drive shaft and a drive belt engaging said pulley and in which said conveyor mounting means comprises a shaft support and means mounting said shaft support for pivotal movement around said axis.

13. Apparatus as in claim 11 in which said conveyor mounting means comprises a shaft support and means mounting said shaft support for pivotal movement around said axis.

14. Apparatus as in claim 11 in which said drive means comprises a pulley carried by said drive shaft and a drive belt engaging said pulley and in which said conveyor mounting means comprises a shaft support and means mounting said shaft support for pivotal movement around said axis.

15. Apparatus as in claim 11 including a housing having opposed sides, said assembly being disposed in said housing with said shaft extending generally perpendicular to said sides, one of said housing sides being formed with an opening permitting access to said path in the inoperative position of said conveyor means.

16. Apparatus as in claim 15 in which said conveyor mounting means comprises a shaft support adjacent to said one end of said shaft and means mounting said shaft support on the other side of said housing for movement around said axis.

* * * * *